US006360674B1

(12) United States Patent
Schüller et al.

(10) Patent No.: US 6,360,674 B1
(45) Date of Patent: Mar. 26, 2002

(54) VEHICLE

(75) Inventors: Uwe Schüller, Nürnberg; Thomas Benker, Pegnitz; Ulrich Hachmann, Prybaum, all of (DE)

(73) Assignee: ABB Daimler-Benz Transporation (Technology) GmbH (DE)

( * ) Notice: Subject to any disclaimer, the term of this patent is extended or adjusted under 35 U.S.C. 154(b) by 0 days.

(21) Appl. No.: 09/402,909

(22) PCT Filed: Nov. 24, 1998

(86) PCT No.: PCT/EP98/07584

§ 371 Date: Feb. 3, 2000

§ 102(e) Date: Feb. 3, 2000

(87) PCT Pub. No.: WO99/41127

PCT Pub. Date: Aug. 19, 1999

(30) Foreign Application Priority Data

Feb. 13, 1998 (DE) ..... 198 05 896

(51) Int. Cl.[7] ..... B61F 3/00
(52) U.S. Cl. ..... 105/199.3
(58) Field of Search ..... 105/157.1, 182.1, 105/199.1, 199.2, 199.3, 199.4, 453

(56) References Cited

U.S. PATENT DOCUMENTS 2,474,471 A * 6/1949 Dolan ..... 105/199.1
3,212,460 A 10/1965 Peras
3,717,107 A * 2/1973 Pangalila ..... 105/199.1
3,913,495 A * 10/1975 Pelabon ..... 105/199.1
5,582,110 A * 12/1996 Hirschfeld ..... 105/199.2
5,588,368 A * 12/1996 Richter et al. ..... 105/199.1
5,636,576 A * 6/1997 Gimenez et al. ..... 105/199.2
5,671,682 A * 9/1997 Holzl et al. ..... 105/199.2

FOREIGN PATENT DOCUMENTS

| | | |
|---|---|---|
| DE | 1063196 | 8/1959 |
| DE | 9304837 | 5/1993 |
| DE | 4243886 | 6/1994 |

* cited by examiner

*Primary Examiner*—Mark T. Le
(74) *Attorney, Agent, or Firm*—Webb Ziesenheim Logsdon Orkin & Hanson, P.C.

(57) ABSTRACT

On a railway vehicle with a car body and a truck with an undercarriage, the car body is supported on the truck by means of connecting devices. To achieve increased operating safety even in the event of a malfunction or failure of the connecting devices, the actuator is fastened rigidly on one end to the truck, and is connected to the car body by means of the mechanical series system consisting of a ball-and-socket joint and a sliding connector.

4 Claims, 2 Drawing Sheets

VEHICLE

BACKGROUND OF THE INVENTION

1. Field of the Invention

This invention relates to a vehicle and more particularly to a railway vehicle.

2. Description of the Prior Art

On a similar railway vehicle of the prior art (DE 42 34 553 A1), between a car body and a truck located underneath it there is a connecting device that has a hydraulic actuator with a piston and a cylinder housing as an adjustment means that can be adjusted axially only in a straight line in relation to one another. The cylinder housing and the piston or the piston rod connected to the piston are each provided with a single-axis knuckle joint, whereby one knuckle joint is coupled with the car body and the other knuckle joint is coupled in an at least a largely perpendicular orientation underneath it to the undercarriage frame of the truck. The actuator is thereby used to control the level of the car body. One disadvantage of this design is that in the event of a failure of a hydraulic and/or pneumatic system, special support elements must be provided, which completely relieve the actuators which are fastened flexibly on both ends, because without additional support means, these actuators can tip around the knuckle connector, as a result of which there can be an unacceptable displacement of the car body with respect to the undercarriage.

SUMMARY OF THE INVENTION

The object of the invention, on a railway vehicle, is to take measures so that the connecting means also perform the necessary support function even in the event of malfunctions or failures of other systems.

The invention has a car body supported by a truck with an undercarriage.

In one configuration of a vehicle as claimed by the invention, a connecting device forms a support mechanism, on which the actuator can always be kept in a perpendicular orientation with respect to one of the two vehicle parts. Rotational and displacement movements between the horizontal plane formed by the truck frame and the plane formed by the underside of the car body, on the other hand, are equalized by knuckle connectors having the characteristic of a ball-and-socket joint and sliding connectors. The sliding connectors for each connecting device thereby have degrees of freedom in translation only in a plane that runs parallel to the plane to which the connecting element or elements are fastened. The connecting devices thereby stand perpendicular to the plane on which they are fastened. In the event of the failure of the actuator that is realized in the form of a hydraulic cylinder, an electrically driven spindle system or a similar mechanism, the actuator can therefore not rotate with respect to the vehicle part to which it is fastened. Consequently, in any case, the minimum axial length of the actuator determines the distance between the vehicle parts that must be kept at a distance from one another and that can move within specified limits with respect to one another. The necessary rotational movements are thereby absorbed by the knuckle joint that is integrated into the connecting device. In this case, the knuckle connector can be realized in the manner of a universal joint or a ball-and-socket joint, while the movement of the sliding connector in translation can be restricted to the magnitude necessary for the operation of the railway vehicle by the attachment of corresponding stops. The connecting device thus consists of a mechanical-functional series arrangement that consists of the actuator, a sliding connector that can be adjusted only in one plane and a knuckle connector that is realized in the manner of a ball-and-socket joint. This connecting device includes, in the form of the changeable-length actuator, an element for the simultaneous limitation of the vertical distance between the undercarriage and the car body, and in the form of the restricted-motion sliding connector, a functional element, the sole purpose of which is to restrict the movement between the two vehicle parts in the direction of the vehicle travel or at a right angle to the direction of travel. The knuckle connector also allows only the inclinations or torsion between the planes described by the vehicle parts that occur during operation.

When the connecting device that is realized in the form of a support and interface between the undercarriage and the car body consists of three components, each of which makes possible different degrees of freedom for the movement between the vehicle parts, movable elements of two of the components can each be connected rigidly with the two vehicle parts, so that the third component always forms the connecting element between the second adjustable elements of the fastened components. In all cases, only the reciprocating movement of the respective actuator is available for the vertical adjustment between the undercarriage and the car body, and only by a maximum of this reciprocating distance can the car body descend toward the undercarriage, because neither the knuckle connector nor the sliding connector allows a movement in this direction, and the longitudinal axis of the actuator cannot be tipped with respect to one of the vehicle parts.

BRIEF DESCRIPTION OF THE DRAWINGS

The invention is explained in greater detail below with reference to the accompanying drawings, which contain schematic diagrams of one exemplary embodiment of the invention.

DESCRIPTION OF THE PREFERRED EMBODIMENTS

Figure 1:
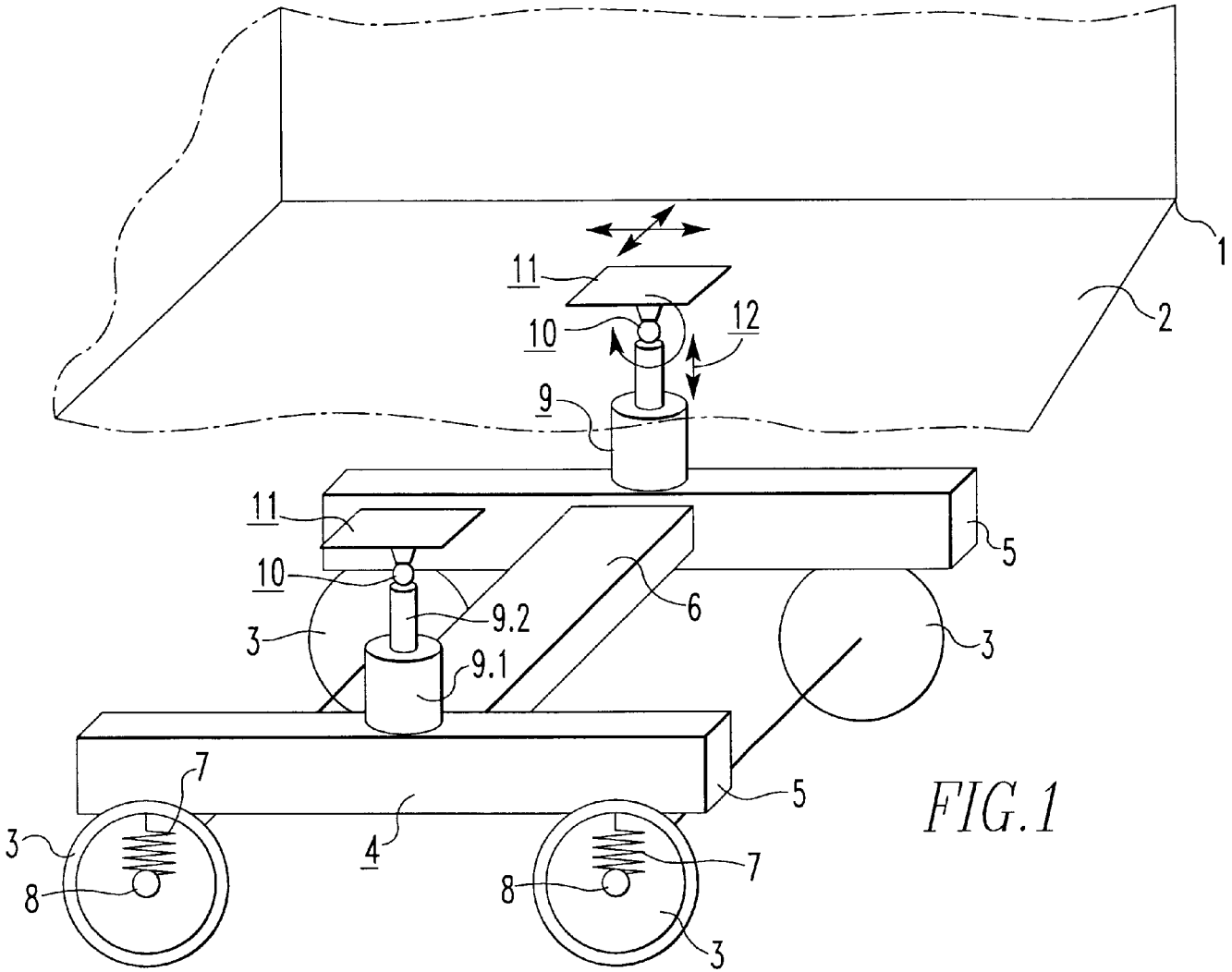
FIG. 1 is a schematic diagram in perspective of an undercarriage with connecting devices to a car body located above it.

FIG. 1 shows a schematic illustration of a vehicle, in particular a railway vehicle, and a car body 1, underneath the floor wall 2 of which there is at least one truck 4. The truck has at least one axle and two wheels 3, and in this case two axles or four wheels 3. The wheels 3 are realized in the form of railroad car wheels. An undercarriage frame thereby supported with longitudinal beams 5 that run in the direction of travel of the truck, which beams 5 are connected to each other by means of at least one cross member 6, are supported by means of primary springs 7 on wheel bearing elements 8 of the wheels 3, and thus couple the wheels 3 together so that they run smoothly. Approximately in the middle of two wheels 3 that are one behind the other in the direction of travel, on each longitudinal beam 5 perpendicular to the plane formed by these longitudinal beams 5, there is a coupling element unit, by means of which the car body 1 is supported with its floor wall 2 on the truck.

The coupling element unit consists of an actuator 9 that acts as a spring element, a knuckle joint connector 10 that can be tilted in all directions and a conducting connector 11 that is located mechanically in series in the direction of action of the actuator 9. The actuators 9, which can be realized in particular in the form of hydraulic cylinders or in the form of geared motors, have two actuator elements 9.1 and 9.2 that can be adjusted axially only in a straight line with respect to one another. The knuckle joint 10 can be realized in the form of a universal or ball-and-socket joint, in the form of an elastomer joint or in the form of a spring steel bar, so that it can execute pivoting movements with a restricted amount of movement in all directions. The sliding connector 11 has degrees of freedom in translation only in a plane that lies parallel to the floor wall 2 of the car body 1. The displacement capability in a plane of this sliding connector, which is not directionally restricted, is thereby limited to specified values. As a result of the association between the individual components 9, 10, 11 of the connecting device, only the actuator can compensate for differences in the distance between the truck 4 and the car body 1, the knuckle joint 10 can compensate only for non-directionally dependent tipping movements, and the sliding connector 11 can compensate only for movements that are directed at right angles to the actuation direction or to its actuation axis 12. In this regard, it is basically unimportant in what sequence the components 9, 10, 11 are connected to one another, as long as the two components on the ends are fastened on one hand to the truck 4 and on the other hand to the car body 1.

Figure 2:
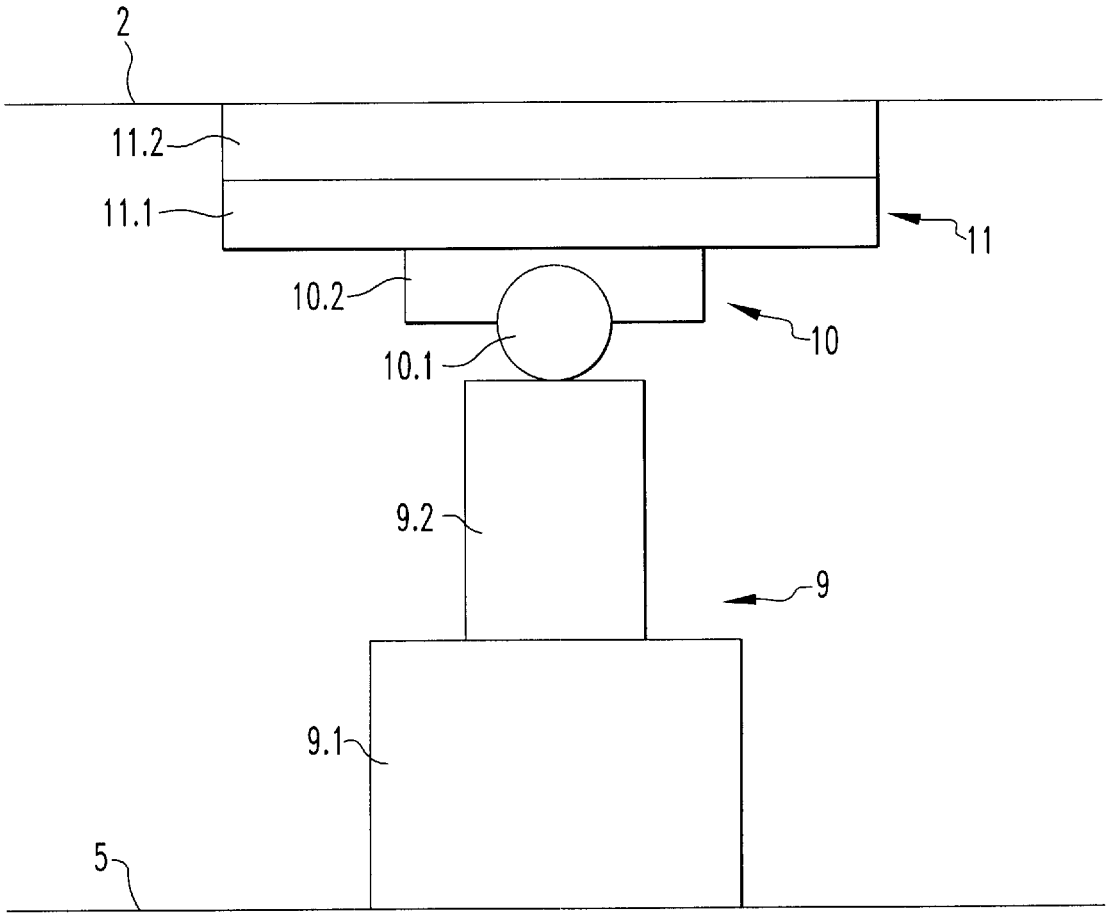
FIG. 2 is a side view of a connecting device.

In the exemplary embodiment depicted in the illustration, the cylinder housing 9.1 is fastened rigidly on one of the longitudinal beams 5, for example by means of hydraulic actuators 9, with a perpendicularly oriented actuator axis 12. As shown in FIG. 2, the other actuator element 9.2 of the actuator 9 is a tappet rod of the cylinder piston that is guided so that it can be displaced in a straight line only along the actuation axis 12, whereby the free end of this actuator element 9.2 is rigidly connected with the first pivoting element 10.1 of the pivoting connector 10, while the second pivoting element 10.2 is rigidly connected to the primary sliding member 11.1 of the sliding element 11. The knuckle joint 10 that is realized in the form of a ball-and-socket joint allows only tipping movements that occur between the planes formed by the longitudinal beams 5 and the floor wall 2. To also be able to compensate for lateral movements between the vehicle parts 1, 3, 4 or the lateral adjustment that results from a distortion of the planes, there is a sliding connector 11, the primary sliding element 11.1 of which is firmly connected with the second pivoting element 10.2 of the knuckle joint 10, and the secondary sliding element 11.2 of which is firmly connected with the floor wall 2 of the car body 1.

In this construction, the actuator 9 can replace flexible elements that act as a secondary suspension. For this purpose, the actuator 9 can be realized in particular in the form of a hydro-pneumatic operating cylinder, and thus can not only allow a vertical equalization between the car body and the truck frame, but can also have spring characteristics like those possessed otherwise by coil springs, air springs or similar springs. The spring characteristic can thereby be controlled as a function of the specific requirements. The force coupling between the car body and the truck for the support of longitudinal and transverse forces can conventionally be provided, for example, by means of control arms, truck center pins or figure-eight coupling elements or elastic buffer or spring elements.

The connecting device 9, 10, 11 can of course also be installed cambered between the car body 1 and the truck 4. In that case, the sliding connector 11 can be also be installed without any adverse effect on function and safety, between the respective longitudinal beam 5 and the facing actuator element 9.1 of the actuator 9. In that case, the secondary joint element 10.2 is firmly connected with the car body 1. Without any change in function, the sliding connector 11 can of course also be installed between the actuator 9 and the knuckle joint 10. In all the variant realizations, and under all operating conditions, the actuator 9 retains its perpendicular position with respect to the truck 4 to the extent that it is connected with it directly on the longitudinal beams 5 or by means of the sliding connector 11. If the actuator 9 sits directly on the car body 1, via the sliding connector 11, it retains its perpendicular position under all operating conditions with respect to the plane thereby defined.

A railway vehicle constructed in the manner described above is suitable in particular for passenger transportation, and meets the high requirements set for the quality of the ride. An efficient transmission path of the inertial forces from the car body to the truck frames is thereby achieved and, in the opposite direction, of the active actuator movements that improve the quality of the ride from the truck into the car body. This transmission occurs with a simultaneous maintenance of the mobility of the truck with respect to the car body in terms of galloping, shaking, rocking and turning-out, as well as the preservation of the stability of the vertical support in the event of the failure of the active suspension stage and the failure of the horizontal centering of the car body. The construction thereby results in a stable position of the car body with reference to the truck. The car body is thereby supported in a stable fashion on the trucks, regardless of whether the actuator is active or passive. The necessary degrees of freedom of the truck with respect to the car body are thereby also achieved in the event of galloping, shaking, rocking and turning-out, as well as in combinations of these motions. In this construction, the truck with active hydro-pneumatic secondary suspension in the form of the actuator 9 has the same degrees of freedom as a conventional truck without active secondary springs. Moreover, in the event of the failure of the active secondary springs, the same degrees of freedom are preserved, which makes possible an uncomplicated safety concept.

What is claimed is:

1. A railway vehicle comprising:

two vehicle parts including a car body and a truck having a frame, at least one connecting device interposed between the two vehicle parts to support the car body on the truck frame, wherein the connecting device is formed by the mechanical-functional series arrangement consisting of:

an actuator having two actuating elements adjustable with respect to one another axially only in a straight line, a sliding connector adjustable in a plane parallel to transverse movements with respect to at least one of the two vehicle parts, a knuckle connector pivotably adjustable with respect to at least one of the two vehicle parts, one of the actuator elements is rigidly fastened perpendicular to one of the two vehicle parts, a first knuckle element of the knuckle connector is firmly connected to the other of the actuator elements, a second knuckle element of the knuckle connector is connected with a primary sliding element of the sliding connector, and a secondary sliding element of the sliding connector is firmly connected with the other of the two vehicle parts.

2. A railway vehicle comprising:

two vehicle parts including a car body and a truck having a fine, at least one connecting device interposed between the two vehicle parts to support the car body on the truck frame, wherein the connecting device is formed by the mechanical-functional series arrangement consisting of:

an actuator having two actuating elements adjustable with respect to one another axially only in a straight line, a sliding connector adjustable in a plane parallel to transverse movements with respect to at least one of the two vehicle parts, a knuckle connector pivotably adjustable with respect to at least one of the two vehicle parts, and one of the actuator elements is rigidly fastened perpendicular to one of the two vehicle parts, a primary sliding part of the sliding connector is firmly connected with the other of the actuator elements, a secondary sliding element of the sliding connector is solidly connected with a first knuckle element of the knuckle connector, and a second knuckle element of the knuckle connector is solidly connected with the other of the two vehicle parts.

3. The railway vehicle as claimed in claim 1, wherein the knuckle connector has an elastic knuckle piece.

4. The railway vehicle as claimed in claim 2, wherein the knuckle connector has an elastic knuckle piece.

* * * * *